United States Patent [19]

Beitzel

[11] 3,936,246

[45] Feb. 3, 1976

[54] MIXING PUMP AND METHOD OF MIXING USING SAME

[75] Inventor: Stuart W. Beitzel, Santa Monica, Calif.

[73] Assignee: Chromalloy American Corporation, City of Industry, Calif.

[22] Filed: June 28, 1974

[21] Appl. No.: 483,917

[52] U.S. Cl. ..... 418/1; 418/15; 418/82; 418/184; 418/238; 417/204

[51] Int. Cl.[2] ..... F01C 21/00; F04C 15/00; F04B 23/12

[58] Field of Search ..... 418/15, 82, 184, 238, 1; 417/204, 503

[56] References Cited

UNITED STATES PATENTS

| | | | |
|---|---|---|---|
| 1,748,744 | 2/1930 | Woolson | 418/15 |
| 1,749,121 | 3/1930 | Barlow | 418/82 |
| 1,757,514 | 5/1930 | Coulombe | 418/15 |
| 2,255,785 | 9/1941 | Kendrick | 418/82 |
| 2,786,422 | 3/1957 | Rosaen et al. | 418/82 |
| 2,918,009 | 12/1959 | Crevoisier | 418/15 |

*Primary Examiner*—John J. Vrablik
*Attorney, Agent, or Firm*—Edward D. O'Brian

[57] ABSTRACT

A rotary vane pump can be constructed so as to utilize an auxiliary inlet port which is used to convey one fluid under pressure to the interior of the pump where such fluid is mixed with fluid drawn into the pump in a normal manner. In the disclosed structure the fluid conveyed to the pump through the auxiliary inlet port is used to force vanes carried by the pump rotor outwardly into contact with an eccentric wall in the pump stator. The vanes are preferably formed and mounted on the rotor so that the fluid conveyed through the auxiliary inlet port passes into the space between the rotor and the stator by flowing alongside the vanes. A structure of this type is preferably utilized with one of the inlet fluids being water and the other of the inlet fluids being a gaseous mixture containing a high proportion of ozone.

6 Claims, 5 Drawing Figures

MIXING PUMP AND METHOD OF MIXING USING SAME

BACKGROUND OF THE INVENTION

The present invention relates to the utilization of rotary vane pumps to achieve an efficient mixing action. More specifically, it primarily relates to the utilization of such pumps to achieve an efficient mixture between a liquid such as water and a gas mixture such as a gas mixture containing a high proportion of ozone.

It is commonly recognized that pumps of virtually all types can be utilized to mix two different fluids together. The mixing action normally achieved with virtually any type of a pump is a result of a turbulence occurring during pump operation. Frequently, such turbulence is inadequate to achieve a desired degree or amount of mixing between two different fluids. This can be illustrated by referring to a common use of rotary vane pumps in mixing two different fluids.

As such pumps are used for this purpose, the two different fluids are normally passed to the interior of the pump through a common inlet. As a pump of this type is operated, a rotor within a stator is turned so as to cause vanes carried by the rotor to move outwardly from the rotor against an eccentric wall so as to create a partial vacuum tending to pull the fluids into the pump. Then, as rotor rotation continues the fluids which have been drawn into the pump are compressed between the eccentric wall and the rotor as the vanes move inwardly until finally they are forced under pressure from within the interior of the pump. This type of action involves considerable physical turbulence and it also involves application of mechanical pressure to the two fluids being mixed.

Unfortunately, this mixing action is not normally sufficiently effective when used with a liquid and a gas to create a solution or dispersion of the gas in the liquid containing as high a proportion of the gas as desired. It is considered that the reasons for this in part relate to the degree or amount of shearing action achieved between the liquid and the gas in a rotary vane pump of the type described. It is also considered that in part this may be the result of the manner in which the two fluids—i.e., a liquid and a gas—are normally brought into contact with one another in a conventional rotary vane pump as indicated.

The relative ineffectiveness of conventional pumps and especially rotary vane pumps in creating a satisfactory mixture of a liquid and a gas is becoming increasingly important as there is increasing recognition of the desirability of forming such mixtures. This can be illustrated with reference to the utilization of ozone. Ozone is normally produced by treating ambient air in an appropriate field so as to convert normal molecules of oxygen into ozone molecules. The gas mixture resulting from such treatment contains all of the gases normally found in ambient air and, in addition, ozone. Although such a gas mixture can be utilized directly for many purposes, it is frequently desired to utilize a mixture of such a gas mixture and a fluid such as water.

In such a mixture the ozone is normally utilized as an oxidizing agent. Thus, for example, a mixture of ozone and water is frequently formed so that the ozone will oxidize impurities within the water. For such a mixture to be effective for oxidizing purposes over a prolonged period it is considered that the ozone should be taken up into the water as by absorption and/or by the formation of exceedingly small bubble-like regions which will not readily separate from the water. The effectiveness of any such mixture and/or solution in causing oxidation is of course dependent upon the proportion of the ozone within the liquid and the time required for such ozone to either break down and/or otherwise escape from the liquid.

In the past, when pumps have been utilized to create intimate mixtures of two fluids such as, for example, an intimate mixture of water and a gas mixture containing ozone, it is not considered that the items in the mixture have been adequately admixed with one another to the extent necessary for the final mixture to be relatively stable and to contain a high proportion of the gas mixture. It has frequently been desired to utilize essentially known types of pumps in creating such mixtures because the techniques of designing and manufacturing such pumps are reasonably well established and because many types of pumps are available at a comparatively nominal cost. Also, when a pump is utilized in forming a mixture as indicated, the pump serves two functions—it forms a mixture as indicated and also it provides a physical force necessary to convey the mixture formed to a desired location.

BRIEF SUMMARY OF THE INVENTION

An object of the present invention is to provide new and improved pumps for use in preparing an admixture of two different fluids in which the fluids are thoroughly and intimately mixed together. The invention is also intended to provide new and improved pumps of the rotary vane type which can produce mixtures as indicated which are relatively stable and which contain a relatively high proportion of gaseous material or materials mixed with the liquid. An object of the invention is also to provide pumps as indicated which may be utilized to cause a reaction between one fluid and either another fluid or an ingredient in the other fluid.

It is not to be assumed from this that the invention is solely concerned with the manufacture of pump or pump-like structures which are intended for mixing purposes. The invention also pertains to a new and improved procedure or process for forming mixtures of two fluids using pumps as indicated in this specification.

In its more limited aspects, the invention is primarily concerned with pumps or pump-like structures as herein described of the rotary vane type for use in thoroughly and intimately mixing water with ozone. In connection with this, the invention is concerned with a new and improved process carried out utilizing such pumps or pump-like structures for forming a mixture containing a relatively high proportion of ozone which is relatively stable over a prolonged period. The invention is further considered with providing pumps or pump-like structures as indicated which can be constructed at a comparatively nominal cost, which can be easily and conveniently utilized for their intended purpose, and which are capable of being operated for relatively prolonged periods with a minimum of servicing or maintenance. The invention is also concerned with a process of the type indicated in the preceding discussion which is relatively simple, which may be easily and conveniently carried out, and which is effective for its intended objective.

In accordance with this invention, certain of these objectives are achieved in a rotary vane pump having a rotor, which has sides and a periphery, the rotor including a slot formed therein extending to its periphery, a vane located within the slot, the vane being movable within the slot generally towards and away from the center of the rotor, drive means for rotating the rotor, a stator positioned around the rotor, said stator fitting closely with respect to the sides of the rotor, said stator including eccentric wall means located adjacent to the periphery of the rotor, these wall means cooperating with the vanes during rotation of the rotor for use in taking fluid into the pump and for use in forcing fluid from the pump, inlet and outlet port means leading into the interior of the stator between the periphery of the rotor and the wall means, the outlet port means being positioned relative to the wall means so as to convey fluid forced from within the interior of the stator during rotation of the rotor and the inlet port means being positioned relative to the wall means so as to convey fluid into the interior of the stator during rotation of the rotor of the improvement which comprises:

auxiliary inlet port means for conveying fluid under pressure located in the stator, the auxiliary inlet port means leading into the interior of the stator adjacent to a side of the rotor at a location spaced from the space between the periphery of the rotor and the wall means, and passage means within the interior of the stator and the rotor placing the auxiliary inlet port means in fluid communication with the portion of the slot furtherest located from the periphery of the rotor so that fluid under pressure conveyed into the stator through the auxiliary port means is supplied to the slot so that it will exert fluid pressure against the vane to cause the vane to move outwardly from the rotor in contact with the wall means.

The process in accordance with this invention involves utilizing a rotary vane pump as indicated in the preceding so that one fluid is supplied to the first mentioned inlet port means while another fluid is supplied to the auxiliary inlet port means under pressure and is distributed under pressure to the interior of the stator along with fluid supplied to the interior of the stator from the first mentioned inlet port means and is mixed with, subjected to mechanical pressure with, and is subjected to a shearing action with the fluid supplied through the first mentioned inlet port means as the pump is operated so that the resultant mixture created by the operation of the pump is pumped through the outlet port means. One such fluid preferably mixed in accordance with this invention is preferably water. The other fluid which is preferably mixed in accordance with this invention is a gaseous mixture of ozone and other gases normally found in ambient air.

BRIEF DESCRIPTION OF THE DRAWING

Because of the nature of this invention, it is considered impossible to both effectively and completely indicate many aspects and features of the invention in a summary such as the preceding. Further details of the invention are best more fully described with reference to the accompanying drawing in which.

Figure 1:
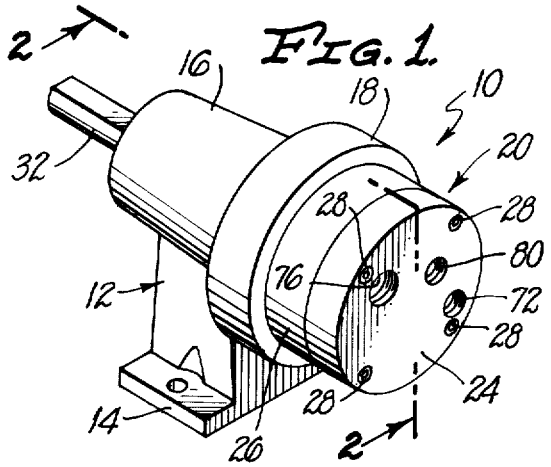
FIG. 1 is an isometric view of a presently preferred embodiment or form of a pump in accordance with this invention.
Figure 3:
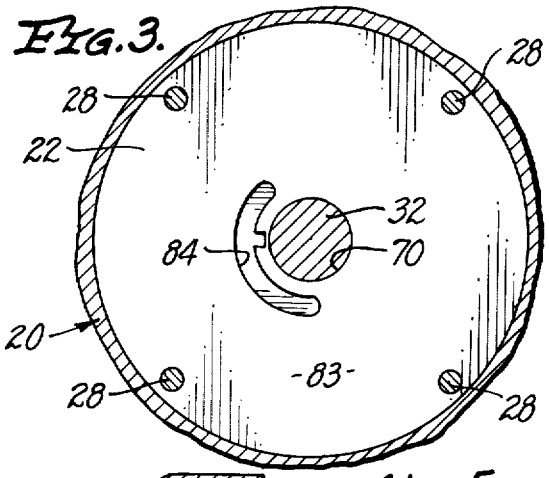
FIG. 3 is a partial cross-sectional view taken at line 3—3 of FIG. 2.

Because it is possible on the basis of the disclosure embodied in this specification to design a variety of somewhat differently appearing and differently constructed pumps utilizing the essential features and principles of the invention summarized or defined in the appended claims, the accompanying drawing it not to be taken as limiting the invention in any respect. The invention utilized within the pump illustrated is essentially of an intangible nature and can be employed in many ways through the use or exercise of routine engineering skill in the pump art.

DETAILED DESCRIPTION

In the drawing there is shown a mixing pump 10 in accordance with this invention which is constructed so as to utilize a centrally located housing 12. This housing 12 has a base 14 which is adapted to be mounted in a conventional manner upon an appropriate support (not shown). This base 14 supports a generally tubular bearing support 16 forming a part of the housing 12. This bearing support 16 carries a generally cup-chaped retainer 18 which also forms a part of the housing 12.

This retainer 18 is utilized to support a stator 20 formed from an inert or relatively inert material upon the housing 12. In a sense, this stator 20 is a part of and/or an extension of the housing 12. It consists of two end plates 22 and 24 which are also formed from such a material separated by a ring 26. These plates 22 and 24 and the ring 26 are mounted upon the retainer section 18 through the use of conventional bolts 28. The ring 26 is provided with an internal cylindrical cavity 30 which is located so that its axis is spaced from and parallel to the axis of a shaft 32 utilized to rotate a cylindrical rotor 34 of an inert or substantially inert material within the cavity 30. Thus, the cavity 30 is eccentric to the shaft 32.

Figure 2:
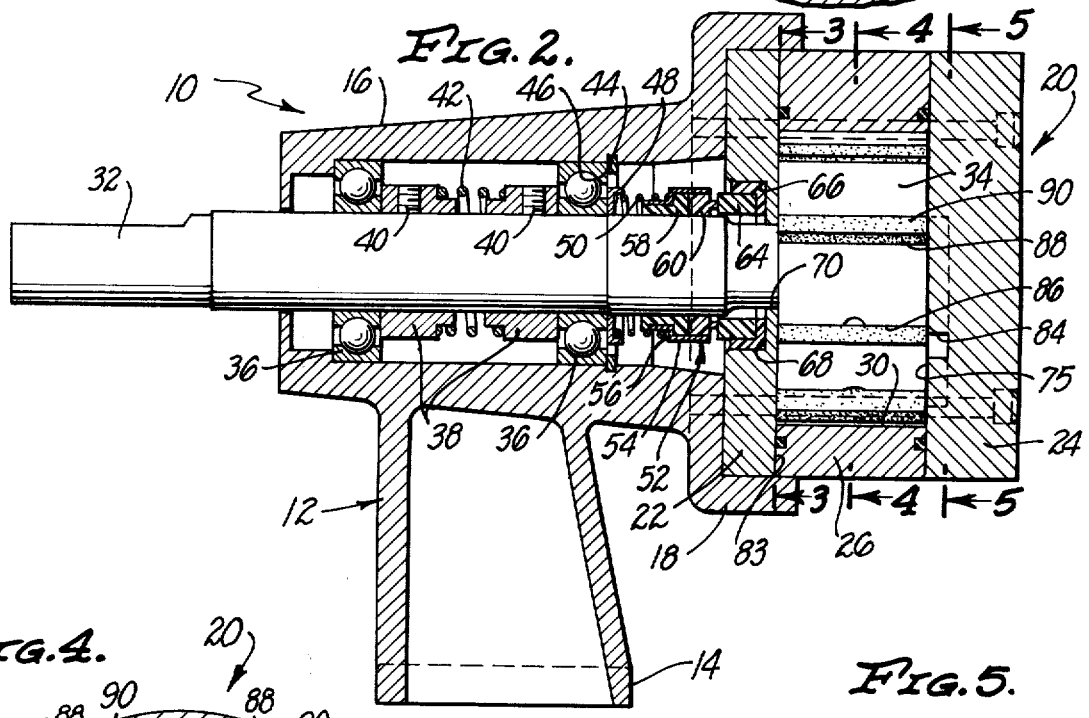
FIG. 2 is a cross-sectional view taken at line 2—2 of FIG. 1.

The shaft 32 is supported on conventional bearings 36 within the bearing support 16. Axial movement of the shaft 32 is preferably prevented by means of shaft collars 38 which are secured to the shaft 32 by conventional screws 40. If desired, these collars 38 may be biased away from one another by means of a coil spring 42. A small snap ring 44 is located in a groove 46 within the bearing support 16 for the purpose of securing the bearings 36 in place. A small thrust plate 48 extending about the shaft 32 fits against one of these bearings 36 appearing to the right in FIG. 2. This thrust plate 48 is used to mount a small coil spring 50 in such a manner that this spring 50 will normally tend to bias a seal assembly 52 towards the right as viewed in FIG. 2.

This seal assembly 52 includes a retainer sleeve 54 having an outwardly extending shoulder 56 located intermediate its ends. This spring 50 engages the shoulder 56 in biasing the assembly 52 as indicated. A washer 58 fits closely within the interior of the sleeve 54 so as to support a rotatable sealing ring 60 forming a part of the assembly 52. This sealing ring 60 includes a projecting flange-like collar 62 which normally rides against and seals against another sealing ring 64 which is supported upon a support washer 66 within a disc-shaped cavity 68 in the end plate 22. This cavity 68 is located concentrically about a shaft opening 70 leading through the plate 22 to the interior of the stator 20.

This assembly 52 and the various other associated parts used with it including the thrust plate 48, the spring 50 and the ring 64 and the washer 66 are intended to seal off the interior of the stator 20 so that leakage will not occur from around the shaft 32 between the shaft 32 and the end plate 22. This structure in effect constitutes a rotary seal. For this seal to be effective when the pump 10 is utilized in forming an ozone-water mixture, the washer 66, the seal ring 64, the seal ring 60 and the washer 58 should all be formed of known materials such as Teflon which are relatively resistant to attack by ozone.

What may be considered to be a conventional inlet port 72 is located in the plate 24 so as to lead to a comparatively short arc groove 74 in the side 75 of this plate 24 facing the cavity 30. The plate 24 also is provided with a conventional outlet port 76 which is in communication with another similarly located arcuate groove 78 located facing the interior of the cavity 30 in the side 75 of the plate 24. These grooves 74 and 78 are located around the axis of the cavity 30 and around the axis of the rotor 34 in positions approximately corresponding to the locations of similar grooves in a conventional rotary vane pump on diametrically opposed sides of these axes. The groove 74 is positioned so as to achieve a drawing in an inlet fluid through the port 72 as the pump 10 is operated; the groove 78 is located so as to convey fluid from the cavity 30 under pressure as the pump 10 is operated.

The plate 24 is also provided with an auxiliary inlet port 80 which leads to a small groove or passage 82 in the side 75 of the plate 24 facing the interior of the cavity 30. This groove or passage 82 extends in a circular path about the axis of the shaft 32 a comparatively small arc nearly corresponding to the arc travelled by the rotor 34 when the pump 10 is operated for that portion of a revolution of the rotor 34 necessary to draw a fluid into the interior of the cavity 30 through the inlet port 72 and the groove 74. The side 75 of the plate 24 and the side 83 of the plate 22 facing the interior of the cavity 30 are also provided with other grooves or passages 84 extending in a curved arcuate path. These passages 84 are mirror images of one another.

These passages 82 and 84 are located so that they will be in communication with the innermost ends or bottoms 85 of slots 86 in the rotor 34. These slots 86 are flat slots extending in planes parallel to the axis of the rotor 34 in manners which are tangential to an imaginary circle drawn about the axis of the shaft 32 and the rotor 34 of lesser diameter than the diameter of the rotor 34. These slots 86 all carry vanes 88 formed from an inert or substantially inert material in such a manner that these vanes 88 can slide relative to the slots 86 as the rotor 34 turns. Sloping surfaces 90 on these vanes 88 are always in contact with a continuous interior wall 92 serving as the periphery of the cavity 30.

Figure 4:
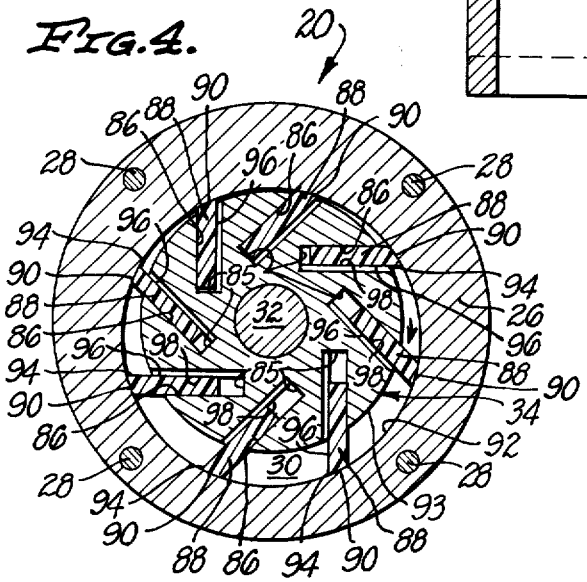
FIG. 4 is a partial cross-sectional view taken at line 4—4 of FIG. 2.
Figure 5:
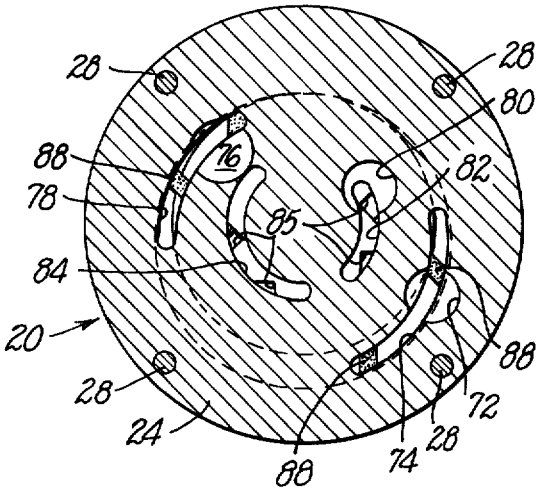
FIG. 5 is a cross-sectional view taken at line 5—5 of FIG. 2.

In extending in this manner, the vanes 88 project from the periphery of the rotor 34 during substantially the entire cycle of rotation of this rotor 34. These vanes 88 are constructed in this manner so that they will have leading edges 94 generally facing the intended direction of rotation of the rotor 34. This direction of rotation is clockwise as the rotor 34 is viewed in FIG. 4 as shown by the arrow in the figure. The vanes 88 preferably fit within the slots 86 so that the leading surfaces 96 of these vanes 88 are separated from the opposed surfaces 98 of the slots 86 a short distance as the rotor 34 is rotated in its intended direction.

This provides what in effect are passages (not separately numbered) between the vanes 88 and the slots 86 which are available to convey a fluid during the operation of the pump 10. Such passages may be achieved by merely making the vanes 88 so that they fit in a "sloppy" manner with respect to the slots 86 or by deliberately grooving either the lead surfaces 96 or the surfaces 98 or both. The spacing between the vanes 88 and the slots 86 is such that only a restricted flow will take place between the bottoms of the slots 88 and the exterior of the rotor 34 as the pump 10 is operated.

During such operation, an inlet fluid is drawn into the inlet port 72 as the rotor 34 is rotated and is compressed and propelled out through the outlet port 76 in a conventional manner. With the pump 10, as this occurs, another fluid to be mixed with the first fluid is supplied to the auxiliary inlet port 80 under pressure. The second fluid will be conveyed during the part of the rotation of the rotor 34 when fluid is drawn in through the inlet port 72 through the passage 82 to the bottoms 85 of the slots 86.

There, the pressure of this secondary fluid will work against the vanes 88 in much the manner in which a fluid works against a piston so as to cause the vanes 88 to move outwardly so that they firmly engage the wall 92 of the cavity 30. This pressure will be exerted on vanes 88 in this manner only so long as the passage 82 is in communication with the bottom 85 of a slot 86. After the bottom 85 of such a slot 86 is rotated past the passage 82 the pressure of the applied secondary fluid is cut off by what amounts to a rotary valve type action achieved as a result of the rotor 34 fitting closely within the cavity 30, and as a result of the limited length of the passage 82.

At this point, the bottom 85 of a slot 86 will move a short distance until it is in communication with the passages 84; such a bottom 85 will remain in communication with these passages 84 until such time as the vane 88 within a particular slot 86 moves past the groove 78 and the outlet port 76. As a particular slot 86 moves past the passages 84 in this manner, contact of a sloping surface 90 on a particular vane 88 against the wall 92 will tend to drive or push a vane 88 generally into its slot 86. This will have the effect of compressing any secondary fluid within the bottom 85 of such slot.

Any fluid compressed in this manner will tend to flow in a direction which is the reverse of the direction of rotation of the rotor 34 through the passages 84 to the bottom 85 of an adjacent slot 86 where the pressure in the bottom 85 of such slot 86 is not as great as it is in the bottom 85 of a slot 86 more closely adjacent to the outlet port 76. This provides a pressure relief action which might tend to bind up the rotation of the rotor 34. It also provides a means whereby any secondary fluid trapped within a bottom 85 of a slot 86 will tend to be forced under pressure to the spaces between adjacent vanes 88 and between the wall 92 and the periphery 93 so as to be admixed with fluids already present and mixed within such spaces.

As the pump 10 is operated the construction of the slots 86 and the vanes 88 permits some of the secondary fluid introduced through the auxiliary outlet port 80 to escape and/or be forced into the areas between the wall 92 and the periphery 93 of the rotor 34 virtually at all times during the rotation of the rotor 34. During what may be regarded as the inlet cycle or portion of the rotation of the rotor 34 the pressure of the applied secondary fluid is primarily responsible for the movement of this fluid into the area between the wall 92 and the periphery 93 during what may be regarded as the compression portion of the rotor.

The inward movement of the vanes 88 is primarily responsible for the interjection of this secondary fluid into the space between the wall 92 and the periphery 93 when slots 86 are positioned with their bottoms 85 in communication with the passages 84. Thus, with this construction what is referred to in the preceding as secondary fluid is in effect added to the fluid drawn into the pump 10 through the inlet port 92 during virtually the entire time when fluid drawn in through the inlet port 72 to within the cavity 30. This is considered to promote an efficient, intimate mixing action.

It is also considered that such an action is promoted by the leading edges 94 tending to "bite" into fluid within the cavity 30 as the rotor 34 is turned as described. These leading edges 94 are considered to create a type of turbulence tending to inwardly direct fluid between the wall 92 and the periphery 93 towards any secondary fluid moving outwardly from the rotor 34 in the space (not numbered) between the slots 86 and the vanes 88. This is believed to result in an extreme degree of turbulence coupled with a continuous application of fluid pressure tending to supplement the normal mechanical compression and turbulence of a fluid moving through a rotary vane pump.

This action within the pump 10 causes significant mixing occurring not only as a result of mixing action achieved in a normal rotary vane pump but also as a result of secondary considerations relating to the utilization of an auxiliary inlet port such as the port 80 to supply a fluid under pressure to the interior of the pump 10. The mixing action achieved is considered to involve a certain amount of shearing force exerted within the pump 10 by various mechanical parts as described in the preceding moving relative to one another. It is considered that the application of mechanical force and/or mechanical forces to the fluids mixed within the pump 10 is quite important in obtaining the desired type of action leading to a desired type of mixture.

The pump 10 is considered to be highly desirable in mixing a gas or a gas mixture with a conventional liquid so that a maximum amount of the gas is either absorbed into or disbursed within the liquid in what may be referred to as finely divided bubbles. In the preferred manner of use of the pump 10 the auxiliary inlet port 80 is connected to a conventional water line utilized to convey tap water at normal line pressures as are encountered in domestic water systems to the pump 10. Also, in the preferred manner of use of the pump 10 the inlet port 72 is connected to a known type of ozonator. It is to be understood, however, that other fluids may be supplied to the pump 10 through these ports.

When the pump 10 is connected as indicated water under pressure is conveyed to the inlet port 80. As the rotor 34 is rotated this water forces the vanes 88 outwardly in the manner described. This water also flows into all portions of the interior of the cavity 30 in such a manner as to provide a degree of lubrication for the vanes 88 as the rotor 34 is turned. The water supplied through this auxiliary inlet port 80 further aides in achieving a maintenance of a sealed condition along all exposed portions of the vanes 88 which engage the wall 92 and the sides 75 and 83. Because an efficient type of seal is achieved at these locations as the rotor 34 is turned a conventional vacuum type action is achieved which tends to pull an ozone-gas mixture into the interior of the cavity 30.

Within the interior of this cavity 30 such a mixture is thoroughly mixed with the water introduced through the auxiliary inlet port 80. Further, the gas-water mixture obtained is subject to continued turbulence as the rotor 34 is turned and is subject to a significant amount of mechanical pressure. This tends to create a product at the outlet port 76 in which the ozone from the gas mixture and the other gases supplied are in solution to as great a degree as possible with the water used.

A mixture produced from a gaseous ozone mixture and tap water will normally contain a significant quantity of gas under compression in the form of small bubbles. A conduit (not shown) connected to the outlet port 76 will appear essentially as a frothy mixture containing surges of liquid. The gaseous materials within such a mixture can be "broken up" and separated to a degree by passing the mixture through a restricted orifice. It is considered a matter of choice as to whether or not a mixture created as described is treated in this manner.

It is considered that one of the prime applications of the invention will be in treating tap water with ozone so as to purify such water by oxidizing appropriate microorganisms and various materials within the tap water capable of being oxidized. For such use the pump 10 must, of course, create an intimate mixture so that all the material within the water capable of being oxidized will be contacted by the ozone so as to be oxidized. Generally speaking, a water-ozone mixture as described should be conveyed through a conduit leading from an outlet port 76 for a sufficient period of time so that the ozone present within the mixture will accomplish substantially complete oxidation of all microorganisms and materials within the water used.

The amount of such time will, of course, vary depending upon the number of factors, such as, the specific quantities of materials mixed together, the specific design of the pump 10, the ambient temperature, the internal temperature within the pump 10, and the like. To avoid the effects of mechanically caused temperature build-up within the pump 10 the liquid supplied to this pump should normally be as cool as reasonably possible. In effect, this liquid acts as a coolant for the pump. This is particularly important in forming ozone-water mixtures since the ozone within such mixtures is temperature sensitive.

The gas or gas mixture supplied to the pump 10 may be utilized to regulate the proportions of water and gas mixed together. Normally, the amount of water which will be supplied to the pump 10 through the auxiliary inlet port 80 will be dependent upon factors such as the pressure of the applied water, the particular geometry of the parts within the pump 10, the speed at which the rotor 34 is operated, and the like. These items will normally be relatively constant and/or completely constant as the pump 10 is operated.

By pressurizing the gas applied through the normal inlet port 72 it is possible to increase the ratio of gas to liquid in the output delivered through the outlet port 76 within reasonable limits beyond the ratio achieved by drawing a gas or gas mixture into the pump 10 by the vacuum action of this pump. Even when the gas or gas mixture supplied to the inlet port 72 is under pressure the normal operation of the pump 10 will tend to achieve a vacuum type action pulling inlet air into the pump 10.

The efficiency of the pump 10 in forming a mixture can also be increased by admitting a liquid into the pump 10 with a gas or gas mixture supplied to this pump. As an example of this, the pump 10 may be operated so that an ozone-gas mixture as obtained from a conventional ozonizer is saturated with water vapor in order to increase its apparent density. Further, if desired, a gas as conveyed to the pump 10 may be otherwise mixed with water so as to create a dispersion of water and gas which is supplied to the inlet 72. This expedient of having a fluid mixed with a gas supplied to the pump 10 is believed to increase the turbulence within the interior of the pump 10 as this pump is operated.

As an example of the use of the pump 10, a pump corresponding to this pump 10 has been operated satisfactorily utilizing tap water supplied to the auxiliary inlet port 80 at a pressure of 10psig. This particular pump used approximately four gallons of tap water per minute while drawing in one and one-half quarter cubic feet per minute of an ozone mixture produced by a commercial ozonizer, this ozone mixture containing sufficient tap water so that approximately one quarter gallon of tap water was supplied to the pump 10 per minute along with the ozone mixture. The complete mixture produced with these quantities of material was considered quite desirable for use in purifying the tap water and for various oxidizing purposes.

It is possible to operate the pump 10 so that a gaseous fluid is introduced into the pump 10 through the auxiliary inlet 80 and so that a liquid is introduced into the pump through the normal inlet 72. This mode of operation is not preferred because the relative incompressability of a liquid is very effective in moving the vanes 88 outwardly from the rotor 34 as a pump as described is operated. If a gas was admitted to the pump through the auxiliary inlet 80 it is considered that the compressability of such gas would make it difficult for the auxiliary fluid to extend the vanes 88 in a manner in which an effective seal could be achieved in the interior of the pump 10. Obviously, the pump 10 can be utilized with a variety of different fluids in different manners so as to achieve an effective mixing action.

I claim:

1. A process for forming a liquid-gas mixture using a rotary vane pump having a stator, a rotor rotatably mounted in said stator, slot means located in said rotor for holding vanes so that such vanes can be moved relative to said rotor, vane means for use in achieving a pumping action located in said slot means, a gas inlet means leading into said stator to within the space between said stator and said rotor, a liquid inlet means for conveying a liquid into said rotor so that such liquid will operate so as to move said vane means outwardly from said rotor and outlet means for receiving a gas-liquid mixture which comprises the steps of:

rotating said rotor, simultaneously supplying a liquid under pressure to said liquid inlet means so as to force said vane means outwardly from said rotor into contact with said stator, drawing a gas into the space between said rotor and said stator as a consequence of the rotation of said rotor within said stator while said vane means are positioned outwardly from said rotor in contact with said stator, allowing liquid to escape from within said rotor through said slot means into the space between said rotor and said stator in contact with gas within said space, mixing said liquid and said gas as a result of turbulence within said stator between said stator and said rotor, such turbulence being caused by the movement of said gas and said liquid and the rotation of said rotor and said vane means, forcing said mixture through said outlet means as a consequence of the rotation of said rotor within said stator while said vane means are positioned in contact with said stator.

2. A process as claimed in claim 1 wherein: said gas contains ozone and said liquid is water.

3. A rotary vane pump having a rotor having sides and a periphery, said rotor including a slot formed therein extending to its periphery, a vane located within said slot, said vane being movable within said slot generally towards and away from the center of said rotor, drive means for rotating said rotor, a stator positioned around said rotor, said stator fitting closely with respect to said sides of said rotor, said stator including eccentric wall means located adjacent to said periphery of said rotor cooperating with said vane during rotation of said rotor for use in taking fluid into said pump and for use in forcing fluid from said pump, inlet and outlet port means leading into the interior of said stator between the periphery of said rotor and said wall means, said outlet port means being positioned relative to said wall means so as to convey fluid forced from within the interior of said stator during rotation of said rotor, and said inlet port means being positioned relative to said wall means so as to convey fluid into the interior of said stator during the rotation of said rotor in which the improvement comprises:

auxiliary inlet port means located in said stator and independent of said first mentioned inlet port means for conveying a second fluid under pressure, said auxiliary inlet port means leading into the interior of said stator adjacent to a side of said rotor at a location spaced from the space between the periphery of said rotor and said wall means, and first passage means within the interior of said stator and said rotor placing said auxiliary inlet port means in fluid communication with the portion oof said slot furtherest located from the said periphery of said rotor so that fluid under pressure conveyed into said stator through said auxiliary inlet port means is supplied to said slot so that it will exert said fluid pressure against said vane to cause said vane to move outwardly from said rotor in contact with said wall means, second passage means between said vane and said slot so that fluid supplied to said slot from said auxiliary inlet port will flow between said vane and said slot into the space between the exterior of said rotor and the exterior of said stator, said first passage means serving as valve means for limiting the flow from said auxiliary inlet port means to said slot only when fluid is being taken into the interior of said stator through said first mentioned inlet port means, pressure relief means for relieving the pressure of fluid within said slot when fluid is being forced from and compressed within the interior of said stator.

4. A rotary vane pump as claimed in claim 1 wherein: said slot and said vane are located so that said vane has a leading edge which proceeds any other part of said vane adjacent to the interior of said stator as said rotor is rotated.

5. A rotor vane pump having a rotor having sides and a periphery, said rotor including a plurality of spaced slots formed therein extending to its periphery, a vane located within each of said slots, said vanes being movable within said slots generally towards and away from the center of said rotor, drive means for rotating said rotor, a stator positioned around said rotor, said stator fitting closely with respect to said sides of said rotor, said stator including eccentric wall means located adjacent to said periphery of said rotor cooperating with said vanes during rotation of said rotor for use in taking fluid into said pump and for use in forcing fluid from said pump, inlet and outlet port means leading into the interior of said stator between the periphery of said rotor and said wall means, said outlet port means being positioned relative to said wall means so as to convey fluid forced from within the interior of said stator during rotation of said rotor, and said inlet port means being positioned relative to said wall means so as to convey fluid into the interior of said stator during the rotation of said rotor in which the improvement comprises:

auxiliary inlet port means located in said stator and independent of said first mentioned inlet port means for conveying a second fluid under pressure, said auxiliary inlet port means leading into the interior of said stator adjacent to a side of said rotor at a location spaced from the space between the periphery of said rotor and said wall means, and first passage means within the interior of said stator and said rotor placing said auxiliary inlet port means in fluid communication with the portion of said slot furtherest located from the said periphery of said rotor so that fluid under pressure conveyed into said stator through said auxiliary inlet port means is supplied to said slot so that it will exert said fluid pressure against said vane to cause said vane to move outwardly from said rotor in contact with said wall means, a plurality of said slots and said vanes, said slots and said vanes being spaced from one another around the periphery of said rotor, second passage means between said vanes and said slots so that fluid supplied to said slots from said auxiliary inlet port will flow between said vanes and said slots into the space between the interior of said rotor and the exterior of said stator, said first passage means serve as a valve means for limiting the flow from said auxiliary inlet port means to said slots only when fluid is being taken into the interior of said stator through said first mentioned port means, pressure relief means for relieving the pressure of fluid within said slots when the fluid within said slots is under a maximum degree of pressure as a result of said vanes being moved generally inwardly within said slots as said rotor rotates, said pressure relief means comprising third passage means for conveying fluid under pressure from within slots to within the interiors of slots trailing the slots where the fluid is already under pressure.

6. A rotary vane pump as claimed in claim 5 wherein:

said slots and said vanes are located so that said vanes all have a leading edge which proceeds any other part of each of said vanes, said leading edges being located adjacent to the interior of said stator as said rotor is rotated.

* * * * *